US011731668B2

(12) United States Patent
Reitz

(10) Patent No.: US 11,731,668 B2
(45) **Date of Patent: *Aug. 22, 2023**

(54) HOPPER CAR DOUBLE DOORS

(71) Applicant: Trinity Rail Group, LLC, Dallas, TX (US)

(72) Inventor: Lee A. Reitz, Euless, TX (US)

(73) Assignee: TRINITY RAIL GROUP, LLC, Dallas, TX (US)

( * ) Notice: Subject to any disclaimer, the term of this patent is extended or adjusted under 35 U.S.C. 154(b) by 172 days.

This patent is subject to a terminal disclaimer.

(21) Appl. No.: 17/132,089

(22) Filed: Dec. 23, 2020

(65) Prior Publication Data

US 2021/0107533 A1 Apr. 15, 2021

Related U.S. Application Data

(63) Continuation of application No. 15/978,620, filed on May 14, 2018, now Pat. No. 10,875,548.

(60) Provisional application No. 62/514,400, filed on Jun. 2, 2017.

(51) Int. Cl.
*B61D 7/02* (2006.01)
*B61D 7/06* (2006.01)

(52) U.S. Cl.
CPC ..... *B61D 7/02* (2013.01); *B61D 7/06* (2013.01); *E05Y 2900/51* (2013.01)

(58) Field of Classification Search
CPC .... B61D 7/00; B61D 7/02; B61D 7/06; E05Y 2900/51
See application file for complete search history.

(56) References Cited

U.S. PATENT DOCUMENTS

| | | | |
|---|---|---|---|
| 1,064,448 | A | 6/1913 | Daniels |
| RE16,374 | E | 7/1926 | Hart |
| 1,706,610 | A | 3/1929 | Hosceit |
| 2,588,316 | A | 3/1952 | Zimmer |
| 2,684,642 | A | 7/1954 | Dorey |
| 4,259,036 | A | 3/1981 | Miller |

(Continued)

OTHER PUBLICATIONS

International Search Report and Written Opinion for PCT Patent Application No. PCT/US2018/0341655, dated Aug. 10, 2018, 12 pages.

(Continued)

*Primary Examiner* — Robert J McCarry, Jr.
(74) *Attorney, Agent, or Firm* — Baker Botts L.L.P.

(57) ABSTRACT

According to some embodiments, a railcar comprises a center sill extending along a longitudinal centerline of the railcar, and two side sills. The two side sills are on opposite sides of, and extend parallel with, the center sill. The railcar further comprises a first inner discharge door coupled to the railcar proximate the center sill on a first side of a longitudinal centerline of the railcar (first side); a second inner discharge door coupled to the railcar proximate the center sill on a second side of the longitudinal centerline (second side); a first outer discharge door coupled proximate the side sill on the first side; a second outer discharge door coupled proximate the side sill on the second side; a first linkage coupling the first inner discharge door to the second outer discharge door; and a second linkage coupling the second inner discharge door to the first outer discharge door.

16 Claims, 5 Drawing Sheets

(56) References Cited

U.S. PATENT DOCUMENTS

| | | | | |
|---|---|---|---|---|
| 7,614,842 | B2 | 11/2009 | Ellefson et al. | |
| 7,752,979 | B2 | 7/2010 | Early | |
| 7,819,067 | B2 | 10/2010 | Early | |
| 10,315,668 | B2 | 6/2019 | Early | |
| 10,875,548 | B2 * | 12/2020 | Reitz | B61D 7/02 |

OTHER PUBLICATIONS

International Preliminary Report on Patentability for PCT Patent Application No. PCT/US2018/034165, dated Dec. 12, 2019, 7 pages.

* cited by examiner 24
68
68
68

HOPPER CAR DOUBLE DOORS

RELATED APPLICATIONS

This application is a continuation of U.S. patent application Ser. No. 15/978,620, entitled, "HOPPER CAR DOUBLE DOORS," filed May 14, 2018 which claims priority to U.S. Provisional Application Ser. No. 62/514,400, entitled "HOPPER CAR DOUBLE DOORS," filed Jun. 2, 2017.

TECHNICAL FIELD

Particular embodiments relate generally to railcars, and more particularly to double door discharge gates for railcars, such as hopper cars for carrying bulk materials.

BACKGROUND

Railway hopper cars transport and sometimes store bulk materials. Hopper cars generally include one or more hoppers which may hold cargo or lading during shipment. Hopper cars are frequently used to transport coal, sand, metal ores, aggregates, grain and any other type of lading which may be satisfactorily discharged through openings formed in one or more hoppers. Discharge openings are typically provided at or near the bottom of each hopper to rapidly discharge cargo. A variety of door assemblies or gate assemblies along with various operating mechanisms have been used to open and close discharge openings associated with railway hopper cars.

Transversely oriented discharge openings and gates are frequently coupled with a common linkage operated by an air cylinder. The air cylinder is typically mounted in the same orientation as the operating gate linkage which is often a longitudinal direction relative to the associated hopper.

Longitudinally oriented discharge openings and doors are often used in pairs that may be rotated or pivoted relative to the center sill or side sills of a hopper car. Longitudinally oriented discharge openings and doors may be coupled with a beam operated by an air cylinder. The air cylinder is typically mounted in the same orientation as the operating beam which is often a longitudinal direction relative to the associated hopper. The operating beam may be coupled to the discharge doors by door struts that push (or pull) the gates open or pull (or push) them closed as the air cylinder moves the operating beam back and forth.

Hopper cars may be classified as open or closed. Hopper cars may have relatively short sidewalls and end walls or relatively tall or high sidewalls and end walls. The sidewalls and end walls of many hopper cars are often formed from steel or aluminum sheets and reinforced with a plurality of vertical side stakes or support posts. Some hopper cars include interior frame structures or braces to provide additional support for the sidewalls.

SUMMARY

Particular embodiments include a pair of longitudinal discharge doors on each side of a longitudinal centerline of a railcar. For each pair of discharge doors, the door closer to the centerline may be referred to as the inner discharge door, and the door closer to the outside of the railcar may be referred to as the outer discharge door. A linkage couples an inner discharge door on a first side of the railcar to an outer discharge door on a second side of the railcar. Opening the inner discharge door on the first side of the railcar also opens the outer discharge door on the second side of the railcar.

According to some embodiments, a railcar comprises an underframe comprising a center sill extending along a longitudinal centerline of the railcar, and two side sills. The two side sills are located on opposite sides of the center sill and extend parallel with the center sill. The railcar further comprises a hopper coupled to the underframe; a first inner discharge door coupled to the underframe proximate the center sill on a first side of a longitudinal centerline of the railcar; a second inner discharge door coupled to the underframe proximate the center sill on a second side of the longitudinal centerline of the railcar; a first outer discharge door coupled to the underframe proximate the side sill on the first side of the longitudinal centerline of the railcar; a second outer discharge door coupled to the underframe proximate the side sill on the second side of the longitudinal centerline of the railcar; a first linkage coupling (e.g., pivotally) the first inner discharge door to the second outer discharge door; and a second linkage coupling (e.g., pivotally) the second inner discharge door to the first outer discharge door.

In particular embodiments, the first linkage is configured such that opening or closing the first inner discharge door also opens or closes the second outer discharge door. The second linkage is configured such that opening or closing the second inner discharge door also opens or closes the first outer discharge door.

In particular embodiments, the railcar further comprises an operating beam. The operating beam is slidably coupled to the center sill and operable to slide in a longitudinal direction. The operating beam is also coupled to the first and second inner discharge doors. Movement of the operating beam in a first direction opens the first and second inner discharge doors and the first and second outer discharge doors. Movement of the operating beam in a second direction, opposite the first direction, closes the first and second inner discharge doors and the first and second outer discharge doors.

In particular embodiments, the first linkage is coupled to a forward-facing end of the first inner discharge door and a forward-facing end of the second outer discharge door. The second linkage may be coupled to a forward-facing end of the second inner discharge door and a forward-facing end of the first outer discharge door. The second linkage may be coupled to a rearward-facing end of the second inner discharge door and a rearward-facing end of the first outer discharge door.

According to some embodiments, a hopper car discharge door system comprises: a first inner discharge door for coupling to a railcar proximate a center sill of the railcar on a first side of a longitudinal centerline of the railcar; a second inner discharge door for coupling to a railcar proximate the center sill on a second side of the longitudinal centerline of the railcar; a first outer discharge door for coupling to a railcar proximate the side sill on the first side of the longitudinal centerline of the railcar; a second outer discharge door for coupling to a railcar proximate the side sill on the second side of the longitudinal centerline of the railcar; a first linkage coupling the first inner discharge door to the second outer discharge door; and a second linkage coupling the second inner discharge door to the first outer discharge door.

In particular embodiments, the first linkage is configured such that opening or closing the first inner discharge door also opens for closes the second outer discharge door. The second linkage is configured such that opening or closing the second inner discharge door also opens or closes the first outer discharge door.

In particular embodiments, the first linkage is coupled to a forward-facing end of the first inner discharge door and a forward-facing end of the second outer discharge door. The second linkage may be coupled to a forward-facing end of the second inner discharge door and a forward-facing end of the first outer discharge door. The second linkage may be coupled to a rearward-facing end of the second inner discharge door and a rearward-facing end of the first outer discharge door.

In particular embodiments, the first linkage is pivotally coupled to the first inner discharge door and the second outer discharge door.

According to some embodiments, a railcar comprises: a center sill extending along a longitudinal centerline of the railcar; an operating beam slidably coupled to the center sill and operable to slide in a longitudinal direction; and a first discharge door coupled to the operating beam. Movement of the operating beam in a first direction opens the first discharge door and movement of the operating beam in a second direction, opposite the first direction, closes the first discharge door. The railcar further comprises a second discharge door coupled to the first discharge door. Opening of the first discharge door opens the second discharge door and closing of the first discharge door closes the second discharge door.

In particular embodiments, the first discharge door is coupled to the railcar on a first side of a longitudinal centerline of the railcar; and the second discharge door is coupled to the railcar on a second side of the longitudinal centerline of the railcar. The second discharge door may be coupled to the first discharge door via a linkage pivotally coupled to the first discharge door and the second discharge door.

In particular embodiments, the railcar further comprises a third discharge door coupled to the operating beam. Movement of the operating beam in the first direction opens the third discharge door and movement of the operating beam in the second direction closes the third discharge door. The railcar further comprises a fourth discharge door coupled to the third discharge door. Opening of the third discharge door opens the fourth discharge door and closing of the third discharge door closes the fourth discharge door.

As an example, the outer discharge door may replace all or a portion of the sloped side sheet of a conventional hopper car. A particular advantage of some embodiments is that the second discharge door increases the size of the discharge opening, which facilitates faster unloading of the commodity within the railcar and faster turnaround times. Particular embodiments of the present disclosure may provide some, none, all, or additional technical advantages.

BRIEF DESCRIPTION OF THE DRAWINGS

For a more complete understanding of the particular embodiments, and the advantages thereof, reference is now made to the following written description taken in conjunction with the accompanying drawings, in which.

DETAILED DESCRIPTION

Railway hopper cars generally include one or more hoppers which may hold cargo or lading (e.g., bulk materials) during shipment. Hopper cars frequently transport coal, sand, metal ores, aggregates, grain, plastic pellets, and any other type of lading which may be satisfactorily discharged through openings formed in one or more hoppers. Discharge openings are typically provided at or near the bottom of each hopper to rapidly discharge cargo. A variety of door assemblies or gate assemblies along with various operating mechanisms have been used to open and close discharge openings associated with railway hopper cars.

Particular embodiments are described with reference to FIGS. 1-6 of the drawings. Like numbers may be used for like and corresponding parts of the various drawings. Various features of the embodiments will be described with respect to hopper car 20 shown in FIGS. 1-4.

Figure 1:
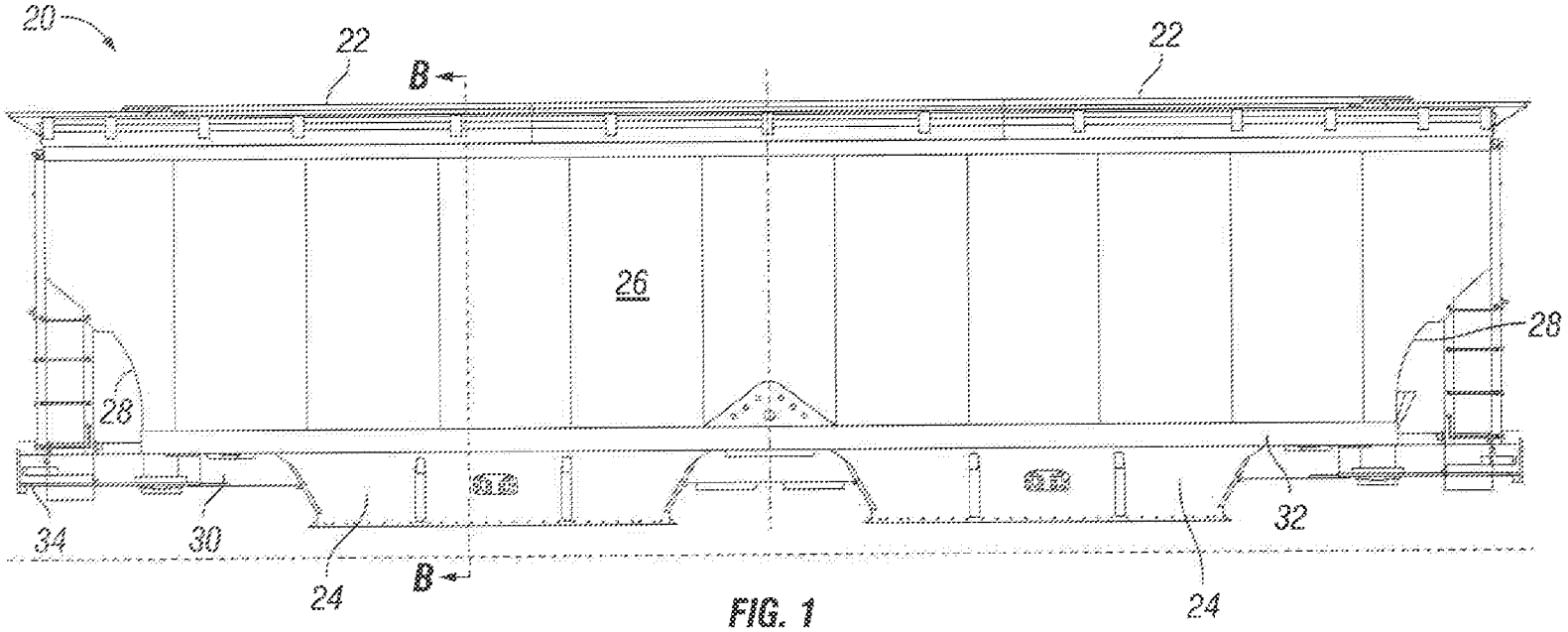
FIG. 1 is a schematic drawing in elevation showing a side view of an example hopper car.

FIG. 1 is a schematic drawing in elevation showing a side view of an example hopper car. Hopper car 20 may carry bulk materials such as coal and other types of lading. Examples of such lading may include sand, metal ores, aggregate, grain, ballast, etc.

Hopper car 20 may be generally described as a covered hopper car. However, other embodiments may include open hopper cars or any other cars suitable for carrying bulk lading. Hopper car 20 includes hoppers 22 with bottom discharge assemblies 24. Discharge assemblies 24 may be opened and closed to control discharge of lading from hoppers 22. As illustrated, hopper car 20 includes two hoppers 22. In other embodiments, hopper car 20 may include one, two, three, or any suitable number of hoppers 22.

In particular embodiments, hopper 22 is configured to carry bulk materials and the interior walls of hopper 22 are generally sloped towards discharge assembly 24 to facilitate discharge of the lading. Multiple hoppers 22 may be separated by interior bulkheads.

In particular embodiments, hopper car 20 may include a pair of sidewall assemblies 26 and sloped end wall assemblies 28 mounted on a railway car underframe. The railway car underframe includes center sill 34 and a pair of shear plates 32. A pair of sill plates 32 provide support for sidewall assemblies 26.

Center sill 34 is a structural element for carrying the loads of the hopper car. Center sill 34 extends longitudinally along the center of hopper car 20 and transfers the various longitudinal forces encountered during train operation from car to car. Shear plates 30 extend generally parallel with center sill 34 and are spaced laterally from opposite sides of center sill 34.

Figure 2:
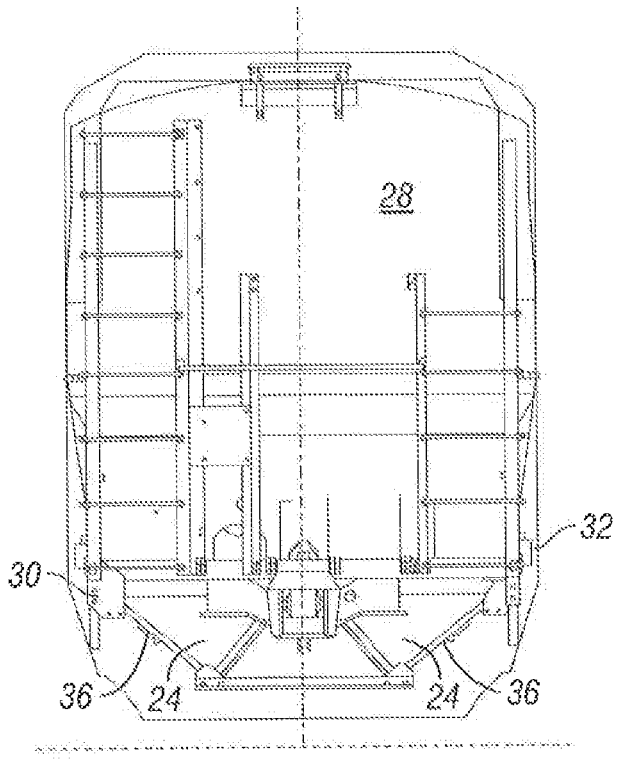
FIG. 2 is a schematic drawing in elevation showing an end view of an example hopper car.

FIG. 2 is a schematic drawing in elevation showing an end view of an example hopper car. FIG. 2 illustrates discharge assemblies 24, end wall assemblies 28, shear plates 30, and sill plates 32 of hopper car 20 illustrated in FIG. 1.

Discharge assembly 24 comprises slope sheet 36. Slope sheet 36 slopes from sidewall assembly 26 towards the center of hopper car 20 to facilitate discharge of the lading from the discharge opening of discharge assembly 24.

Figure 3:
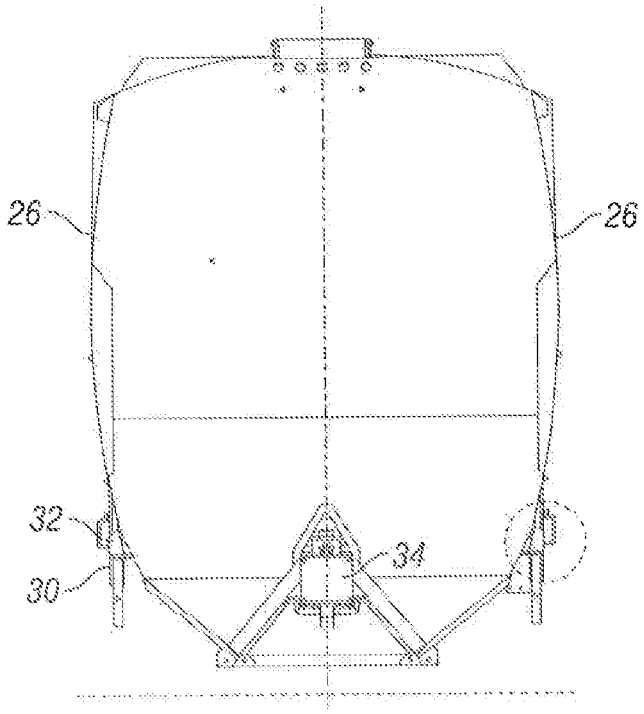
FIG. 3 is a schematic drawing showing a cross section view of an example hopper car taken along lines B-B of FIG. 1.

FIG. 3 is a schematic drawing showing a cross section view of an example hopper car taken along lines B-B of FIG. 1. FIG. 3 illustrates side wall assemblies 26, shear plates 30, sill plates 32, and center sill 34 of hopper car 20 illustrated in FIG. 1.

Figure 4:
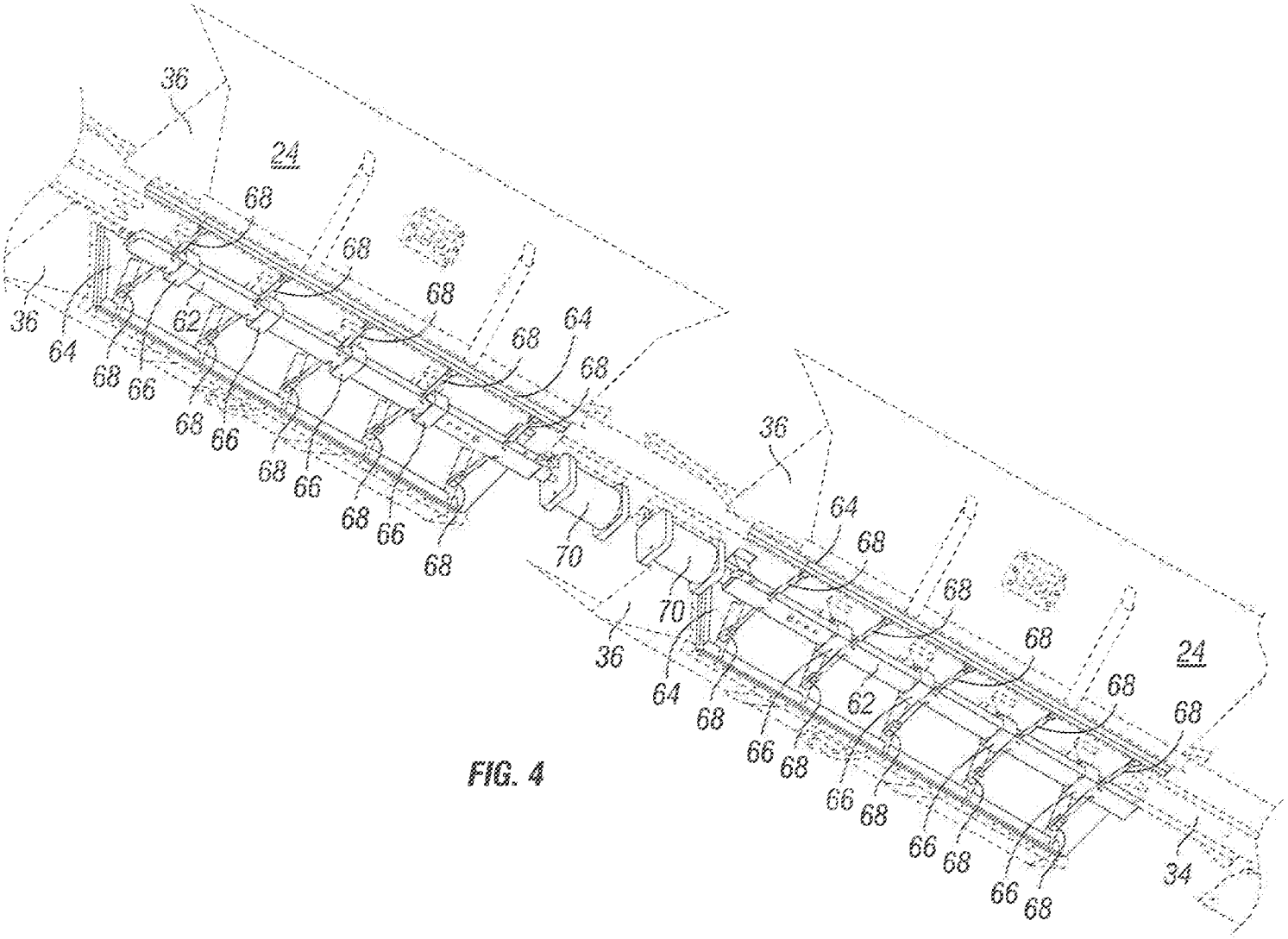
FIG. 4 is a block diagram illustrating longitudinal discharge doors underneath an example hopper car.

FIG. 4 is a schematic perspective drawing illustrating longitudinal discharge doors underneath an example hopper car. FIG. 4 illustrates in more detail the two discharge assemblies 24 illustrated in FIG. 1. Discharge assembly 24 includes operating beam 62, discharge doors 64, guides 66, door struts 68, and operating cylinder 70.

Operating beam 62 is coupled to center sill 34 by guides 66. Operating beam 62 is coupled to discharge door 64 by door struts 68. Operating cylinder 70 is coupled to operating beam 62 and is operable to move operating beam 62 back and forth through guides 66.

Operating beam 62 may comprise a steel box beam, may be extruded from aluminum or steel, may be pultruded as a fiber reinforced composite, such as a fiber or carbon composite, or any other suitable material.

Portions of slope sheet 36 cooperate with adjacent portions of center sill 34 to define longitudinal discharge openings. Longitudinal discharge openings are disposed along opposite sides of center sill 34.

Discharge doors 64 are hinged proximate to center sill 34. Various types of mechanical hinges may engage discharge doors 64 with center sill 34.

Discharge doors 64 are illustrated in the closed position, which prevents the discharge of lading through the longitudinal discharge openings. In operation, operating cylinder 70 moves operating beam 62 through guides 66 to open discharge doors 64 via door struts 68.

At a first end, door struts 68 are rotationally coupled to operating beam 62. At a second end, door struts 68 are rotationally coupled to discharge door 64. In particular embodiments, rotational coupling may be achieved via ball joints.

Operating cylinder 70 is operable to move operating beam 62 back and forth through guides 66. In particular embodiments operating cylinder 70 may comprise a pneumatic cylinder, or any type of motor suitable for moving operating beam 62 in a longitudinal direction.

Longitudinal movement of operating beam 62 results in radial extension of door struts 68 to move discharge doors 64 from their open position to their closed position. Movement of operating beam 62 in the opposite direction results in pulling, pushing, or moving discharge doors from their closed position to their open position which facilitates rapid discharge of a lading contained within railway hopper car 20.

In particular embodiments, each hopper 24 of hopper car 20 may be operated independently of each other. In other embodiments, each hopper 24 may be operated in unison by a single operating cylinder 70 and operating beam 62.

The examples illustrated in FIGS. 1-4 include a discharge door 64 on each side of the longitudinal centerline of hopper car 20 that is hinged near center sill 34 and closes against slope sheet 36. Operating beam 62 may operate both discharge doors 64 simultaneously.

Particular embodiments may include a pair of discharge doors 64 on each side of the centerline of hopper car 20. For example, all or a portion of slope sheet 36 may be replaced by another discharge door 64. Operating beam 62 may operate both pairs of discharge doors 64 simultaneously. An example is illustrated in FIGS. 5 and 6.

Figure 5:
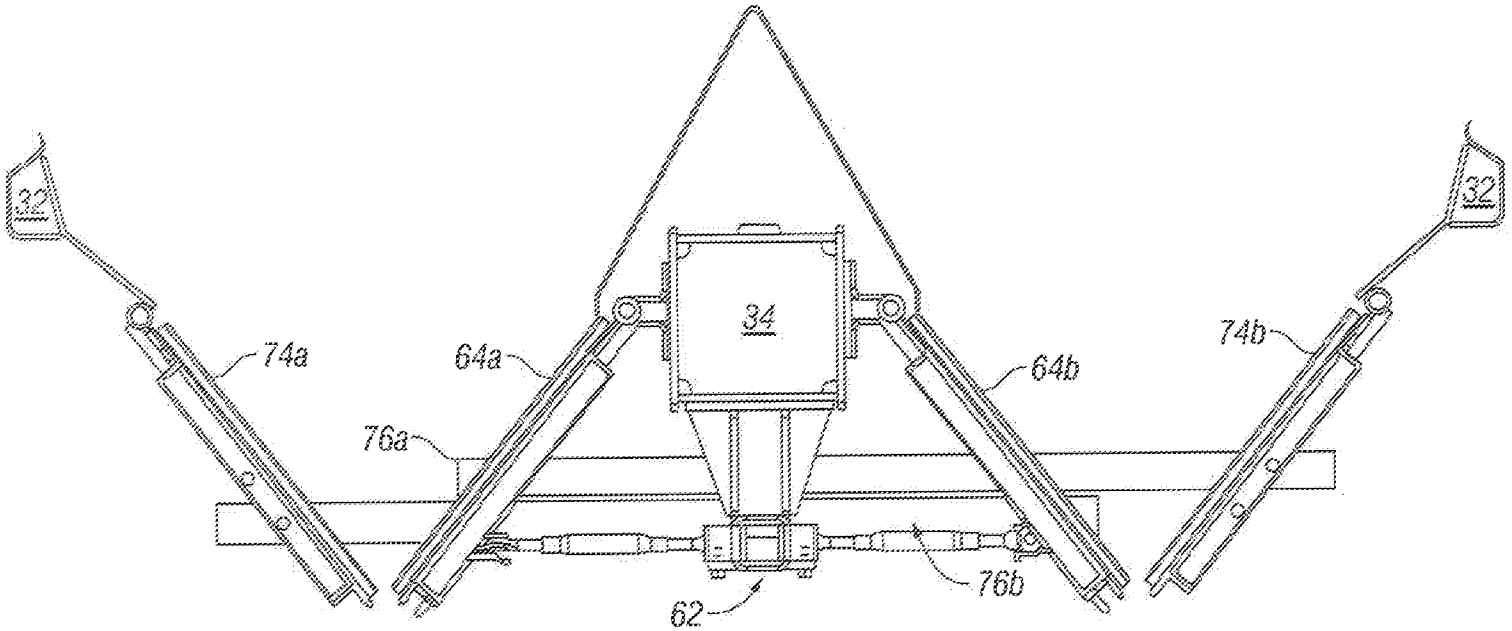
FIG. 5 is a schematic drawing illustrating a longitudinal discharge gate with double doors in the closed position, according to a particular embodiment.
Figure 6:
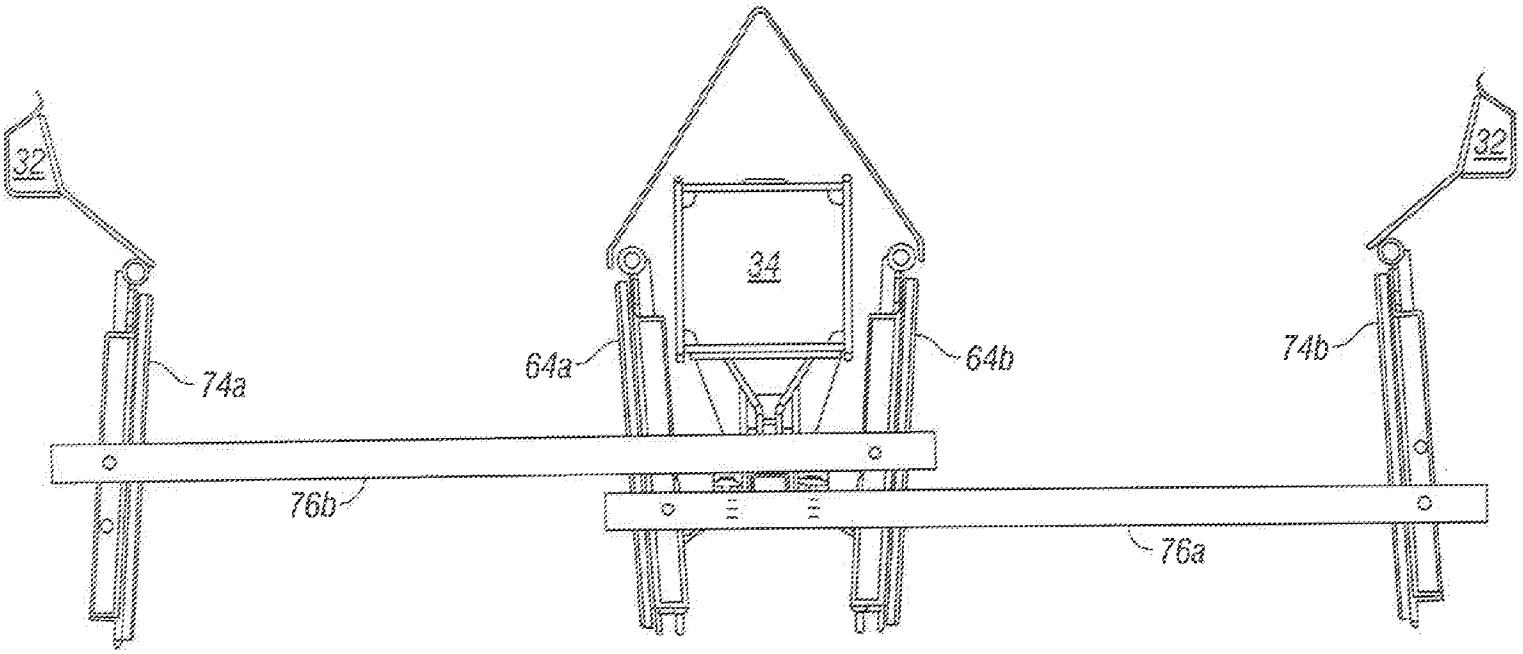
FIG. 6 is a schematic drawing illustrating a longitudinal discharge gate with double doors in the open position, according to a particular embodiment.

FIG. 5 is a schematic drawing illustrating a longitudinal discharge gate with double doors in the closed position, according to a particular embodiment. Center sill 34 extends longitudinally down the longitudinal centerline of hopper car 20. Discharge doors 64*a* and 64*b* are hinged proximate center sill 34, similar to discharge doors 64 described with respect to FIGS. 1-4. Discharge doors 74*a* and 74*b* are hinged proximate sill plates 32. Discharge doors 64*a* and 74*a* form a pair of double doors on one side of the longitudinal centerline of hopper car 20. Discharge doors 64*b* and 74*b* form another pair of double doors on the other side of the longitudinal centerline of hopper car 20. Discharge doors 64*a* and 64*b* may be referred to as inner discharge doors. Discharge doors 74*a* and 74*b* may be referred to as outer discharge doors.

Discharge doors 64 and 74 swing away from each other to discharge a commodity in hopper car 20. Both discharge doors 64 and 74 may be simultaneously opened and closed by operating beam 62. The inner discharge door on one side of center sill 34 and the outer discharge door on the other side of center sill 34 swing open (or closed) in the same direction. For example, discharge doors 64*a* and 74*b* swing open (or closed) in the same direction, and discharge doors 64*b* and 74*a* swing open (or closed) in the same direction.

Linkage 76 couples an inner discharge door to an outer discharge door. For example, linkage 76*a* couples discharge doors 64*a* and 74*b*, and linkage 76*b* couples discharge doors 64*b* and 74*a*. When operating beam 62 opens discharge doors 64*a* and 64*b*, discharge doors 74*a* and 74*b* also open because they are coupled to discharge doors 74*b* and 74*a*, respectively. Similarly, when operating beam 62 closes discharge doors 64*a* and 64*b*, discharge doors 74*a* and 74*b* also close.

FIG. 6 is a schematic drawing illustrating a longitudinal discharge gate with double doors in the open position, according to a particular embodiment. When operating beam 62 opens discharge door 64*a*, linkage 76*a* coupled to discharge door 74*b* causes discharge door 74*b* to open. When operating beam 62 opens discharge door 64*b*, linkage 76*b* coupled to discharge door 74*a* causes discharge door 74*a* to open.

Linkage 76 synchronizes the opening and closing of discharge doors 64 and 74 so that the speed and timing is the same. Although linkages 76*a* and 76*b* are illustrated on one end of discharge doors 64 and 74, particular embodiments may include linkages 76*a* and 76*b* on both ends of discharge doors 64 and 74. Some embodiments may include linkage 76*a* on one end of discharge doors 64 and 74, and linkage 76*b* on the opposite end of discharge doors 64 and 74.

A particular advantage of coupling linkage 76 to an end of discharge doors 64 and 74 is that linkage 76 does not interfere with the discharge of lading. The ends of discharge doors 64 and 74 may be referred to as the forward-facing end (i.e., the end facing the front of the railcar) and the rearward-facing end (i.e., the end facing the rear of the railcar).

Linkage 76 may comprise flat bar, round bar, or any other suitable material for coupling two discharge doors. Linkage 76 may comprise a rigid linkage (as illustrated), or linkage 76 may be hinged or jointed. Linkage 76 may be pivotally coupled to discharge doors 64 and 74.

A particular advantage of the dual doors, double doors, or bomb bay style doors is a larger discharge opening to increase product flow. Faster product flow may lead to faster unloading time and faster turnaround time.

Although the components in FIGS. 1-6 are described with respect to a particular hopper car with a particular number of hoppers, particular embodiments may include any suitable type of railcar with any suitable number of discharge gates.

Although particular embodiments and their advantages have been described in detail, it should be understood that various changes, substitutions and alternations can be made herein without departing from the spirit and scope of the embodiments.

The invention claimed is:

1. A railcar comprising:

an underframe comprising a center sill extending along a longitudinal centerline of the railcar, and two side sills, the two side sills located on opposite sides of the center sill and extending parallel with the center sill;

a hopper coupled to the underframe;

a first inner discharge door coupled to the underframe proximate the center sill on a first side of a longitudinal centerline of the railcar;

a second inner discharge door coupled to the underframe proximate the center sill on a second side of the longitudinal centerline of the railcar;

a first outer discharge door coupled to the underframe proximate the side sill on the first side of the longitudinal centerline of the railcar;

a second outer discharge door coupled to the underframe proximate the side sill on the second side of the longitudinal centerline of the railcar;

a first linkage coupling the first inner discharge door to the second outer discharge door, wherein the first linkage is coupled to a forward-facing end of the first inner discharge door and a forward-facing end of the second outer discharge door; and a second linkage coupling the second inner discharge door to the first outer discharge door.

2. The railcar of claim 1, wherein:

the first linkage is configured such that opening the first inner discharge door also opens the second outer discharge door; and the second linkage is configured such that opening the second inner discharge door also opens the first outer discharge door.

3. The railcar of claim 1, wherein:

the first linkage is configured such that closing the first inner discharge door also closes the second outer discharge door; and the second linkage is configured such that closing the second inner discharge door also closes the first outer discharge door.

4. The railcar of claim 1, further comprising an operating beam, wherein:

the operating beam is slidably coupled to the center sill and operable to slide in a longitudinal direction;

the operating beam is coupled to the first and second inner discharge doors; and movement of the operating beam in a first direction opens the first and second inner discharge doors and the first and second outer discharge doors.

5. The railcar of claim 4, wherein movement of the operating beam in a second direction, opposite the first direction, closes the first and second inner discharge doors and the first and second outer discharge doors.

6. The railcar of claim 1, wherein the second linkage is coupled to a forward-facing end of the second inner discharge door and a forward-facing end of the first outer discharge door.

7. The railcar of claim 1, wherein the second linkage is coupled to a rearward-facing end of the second inner discharge door and a rearward-facing end of the first outer discharge door.

8. The railcar of claim 1, wherein the first linkage is pivotally coupled to the first inner discharge door and the second outer discharge door.

9. A hopper car discharge door system comprising:

a first inner discharge door for coupling to a railcar proximate a center sill of the railcar on a first side of a longitudinal centerline of the railcar;

a second inner discharge door for coupling to a railcar proximate the center sill on a second side of the longitudinal centerline of the railcar;

a first outer discharge door for coupling to a railcar proximate the side sill on the first side of the longitudinal centerline of the railcar;

a second outer discharge door for coupling to a railcar proximate the side sill on the second side of the longitudinal centerline of the railcar;

a first linkage coupling the first inner discharge door to the second outer discharge door; and a second linkage coupling the second inner discharge door to the first outer discharge door, wherein the second linkage is coupled to a forward-facing end of the second inner discharge door and a forward-facing end of the first outer discharge door.

10. The hopper car discharge door system of claim 9, wherein:

the first linkage is configured such that opening the first inner discharge door also opens the second outer discharge door; and the second linkage is configured such that opening the second inner discharge door also opens the first outer discharge door.

11. The hopper car discharge door system of claim 9, wherein:

the first linkage is configured such that closing the first inner discharge door also closes the second outer discharge door; and the second linkage is configured such that closing the second inner discharge door also closes the first outer discharge door.

12. The hopper car discharge door system of claim 9, wherein the first linkage is coupled to a forward-facing end of the first inner discharge door and a forward-facing end of the second outer discharge door.

13. The hopper car discharge door system of claim 9, wherein the first linkage is pivotally coupled to the first inner discharge door and the second outer discharge door.

14. A hopper car discharge door system comprising:

a first inner discharge door for coupling to a railcar proximate a center sill of the railcar on a first side of a longitudinal centerline of the railcar;

a second inner discharge door for coupling to a railcar proximate the center sill on a second side of the longitudinal centerline of the railcar;

a first outer discharge door for coupling to a railcar proximate the side sill on the first side of the longitudinal centerline of the railcar;

a second outer discharge door for coupling to a railcar proximate the side sill on the second side of the longitudinal centerline of the railcar;

a first linkage coupling the first inner discharge door to the second outer discharge door; and a second linkage coupling the second inner discharge door to the first outer discharge door, wherein the second linkage is coupled to a rearward-facing end of the second inner discharge door and a rearward-facing end of the first outer discharge door.

15. The hopper car discharge door system of claim 14, wherein the first linkage is coupled to a forward-facing end of the first inner discharge door and a forward-facing end of the second outer discharge door.

16. The hopper car discharge door system of claim 14, wherein the first linkage is pivotally coupled to the first inner discharge door and the second outer discharge door.

* * * * *